United States Patent [19]

Nonoyama et al.

[11] 4,123,904

[45] Nov. 7, 1978

[54] APPARATUS FOR INTRODUCING SECONDARY AIR INTO AN INTERNAL COMBUSTION ENGINE

[75] Inventors: Takao Nonoyama, Toyota; Toshiro Harada, Okazaki; Yukio Suzuki, Toyota, all of Japan

[73] Assignee: Toyota Jidosha Kogyo Kabushiki Kaisha, Toyota, Japan

[21] Appl. No.: 746,793

[22] Filed: Dec. 2, 1976

[30] Foreign Application Priority Data

Sep. 3, 1976 [JP] Japan ..... 51-105031

[51] Int. Cl.[2] ..... F01N 3/10; F01N 3/15

[52] U.S. Cl. ..... 60/290

[58] Field of Search ..... 60/289, 290, 287

[56] References Cited

U.S. PATENT DOCUMENTS

| | | | |
|---|---|---|---|
| 3,927,524 | 12/1975 | Cholvin | 60/289 |
| 3,950,943 | 4/1976 | Paddock et al. | 60/290 |
| 3,955,364 | 5/1976 | Lewis | 60/290 |
| 4,007,756 | 2/1977 | Umino | 60/290 |
| 4,077,208 | 3/1978 | Sawada | 60/294 |

*Primary Examiner*—Louis J. Casaregola

*Attorney, Agent, or Firm*—Stevens, Davis, Miller & Mosher

[57] ABSTRACT

An apparatus is provided for introducing secondary air for into an internal combustion engine. The apparatus has an air pump coupled to an air injection pipe system, the latter having an end terminating upstream of the catalytic converter, for introducing an amount of secondary air into the exhaust system of the engine. The apparatus further includes a valve device for maintaining the secondary air directed to the exhaust system from the air pump at determined constant pressure; thus, the amount of secondary air introduced into the exhaust system is effectively decreased during high rotational speed engine operation in order to prevent the catalytic converter from being overheated.

4 Claims, 4 Drawing Figures

APPARATUS FOR INTRODUCING SECONDARY AIR INTO AN INTERNAL COMBUSTION ENGINE

FIELD OF THE INVENTION

The present invention relates to an apparatus for introducing secondary air into an exhaust system of an engine by means of an air pump which is driven by a crankshaft of the engine.

BACKGROUND OF THE INVENTION

Already known is a so-called secondary air injection apparatus for decreasing HC (hydro carbon) and CO (carbon monoxide) component emissions from an internal combustion engine. In such an apparatus air from an air pump driven by a crankshaft of the engine is introduced into an exhaust manifold of the engine through an air injection system including an air injection pipe, a check valve and air injection manifold. The secondary air thus introduced into the exhaust manifold operates to oxidize the CO and HC components remaining in the exhaust gas for suppressing toxic emission from the engine.

If the engine has a catalytic converter arranged in the exhaust system, it is necessary to decrease the amount of the secondary air introduced into the exhaust system during high speed and heavy load engine operation in order to prevent the catalytic converter from being overheated. Therefore, in a known air injection apparatus for an internal combustion engine provided with a catalytic converter, a pressure relief valve is connected to an output of the air pump of the apparatus. The relief valve has a spring-urged valve member adapted for discharging an extra amount of air from the air pump into the atmosphere, when the pressure in the air injection pipe is increased. However, with this type of air injection apparatus the amount of air can not be fully and effectively decreased during the high rotational speed operation, because it is not possible to maintain a predetermined constant pressure of secondary air merely by a pressure relief valve. Therefore, overheating of the catalytic converter during high rotational speed operation can not be effectively prevented.

SUMMARY OF THE INVENTION

An object of the present invention is to provide an air injection apparatus capable of overcoming the above-mentioned drawback of the known art.

Another object of the present invention is to provide an air injection apparatus capable of maintaining the secondary air at a predetermined constant pressure in the air injection pipe.

Still another object of the present invention is to provide an air injection apparatus capable of effectively decreasing the amount of secondary air during high rotational speed engine operation.

According to the present invention an apparatus is provided for introducing secondary air into an internal compustion engine, comprising:

an air pump means driven by the crankshaft of the engine;

pipe means connecting the air pump to the exhaust system of the engine in a position located upstream of the catalytic converter arranged in the exhaust system, so that an amount of secondary air is introduced into the exhaust system in accordance with rotation of said air pump to oxidize the toxic component in the exhaust gas in the catalytic converter;

vacuum operated flow control valve means arranged between the air pump and the pipe means for controlling the amount of secondary air introduced into the pipe means, and;

pressure control valve means for controlling the vacuum pressure level at the vacuum operated valve means to maintain the secondary air introduced into the pipe means at a predetermined constant pressure when the engine is operating in such a running condition that the engine rotational speed is higher than a predetermined rotational speed. As a result of this arrangement, the amount of secondary air is effectively reduced during this high rotational speed running condition and, therefore, the catalytic converter is effectively prevented from being overheated.

DETAILED DESCRIPTION OF A PREFERRED EMBODIMENT

Figure 1:
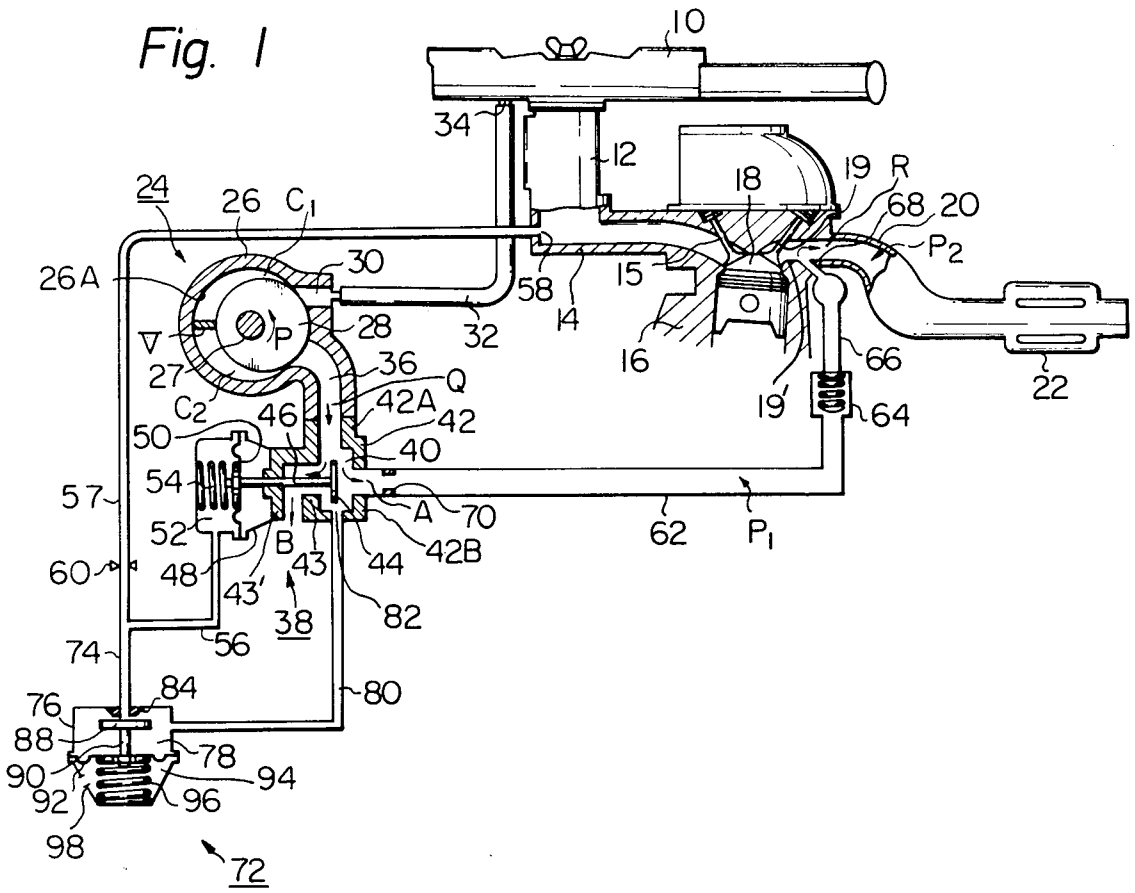
FIG. 1 shows a schematic view of an apparatus for introducing secondary air into the exhaust system according to the invention.

Referring to FIG. 1, numeral 10 designates an air cleaner for introducing air from the atmosphere into a carburetor 12, which is arranged downstream of the air cleaner 10, for producing a combustible air-fuel mixture. The air-fuel mixture is introduced through an intake manifold 14 into a combustion chamber 18, formed in an engine body 16, when an intake valve 15 is opened. The exhaust gas resulting from the combustion of the air-fuel mixture in the combustion chamber 18 is exhausted to an exhaust manifold 20 when an exhaust valve 19 is opened. The exhaust gas then flows into a catalytic converter 22, connected to the exhaust manifold 20, which oxidizes the CO and HC components remaining in the exhaust gas.

Numeral 24 designates an air pump of the so-called vane type which comprises a rotor housing 26. A rotor 28 is arranged in the housing 26 and is eccentrically secured to a drive shaft 27. A vane member V is secured to the outer cylindrical surface of the rotor 28 so that an outer end surface of the member V always contacts an inner circular cylindrical surface $26_A$ during the rotation of the vane V. In order to rotate the rotor 28, the shaft 27 is kinematically connected to the crankshaft (not shown) of the engine, via a not shown mechanism, such as a belt and pulley mechanism. An inlet port 30 of the pump 24 is, via an air hose 32, connected to a union 34 adapted for communicating the hose 32 with a space formed downstream of a filter member (not shown) disposed in the air cleaner 10. An outlet port 36 of the pump 24 is connected to a vacuum operated flow control valve 38.

The flow control valve 38 is capable of supplying only a necessary amount of secondary air into the exhaust system, and has a body 42 which forms a flow control chamber 40 therein. The chamber 40 is provided with an inlet $42_A$ communicating with the outlet port 36 of the pump 24, a first valve seat $42_B$ opened to the exhaust manifold 20 for introducing secondary air thereto and a second valve seat 43 opened to the atmosphere for discharging any excess amount of air. A valve member 44 of plate shape is arranged between the valve seats $42_B$ and 43, which member 44 is connected, through a valve rod 46 slidably supported by the body 42, to a diaphragm 50 arranged across the interior of a diaphragm case 48 secured to the body 42. On one side of the diaphragm 50 a vacuum chamber 52 is formed, in which chamber 52 a spring 54 is arranged for urging the diaphragm 50 toward the valve body 42. The chamber 52 is, through vacuum signal tubes 56 and 57, connected to a vacuum pressure signal port 58 formed in the intake manifold 14 for introducing a vacuum signal to the chamber 52. An orifice 60 is arranged in the tube 57 for restricting the level of vacuum signal transmitted to the chamber 52. The valve seat $42_B$ of the valve 38 is connected to an exhaust port 19' formed in the engine body 16 near an exhaust valve 19, via an air injection pipe 62, a check valve 64, an air injection manifold 66 and an air injection nozzle 68. An orifice 70 is formed in the hose 62 for restricting the amount of secondary air directed to the air injection pipe 62.

The apparatus according to the invention further includes a pressure control valve 72 for operating the flow control valve 38. The valve 38 is operated in such a manner that a predetermined constant pressure ($P_1$) of secondary air is supplied to the air injection pipe 62 from the valve 38, as shown by an arrow A. The maintaining of this constant pressure results in only a necessary amount of air being introduced into the exhaust manifold 20 and any excess amount of air being discharged to the atmosphere through a port 43' connected to the valve seat 43, as shown by an arrow B. The valve 72 has a body 76 and a diaphragm 92 arranged across the interior of the body 76 so as to form an air pressure chamber 78 on one side of the diaphragm 92. The chamber 78 is connected through a tube 74 to the tubes 56 and 57. The chamber 78 is also connected through a tube 80 to an air pressure signal port 82, which is formed in the body 42 and which communicates the chamber 78 with the chamber 40. A valve member 88 is arranged in the chamber 78 so as to face a valve seat 84 which is formed on the body 76 for connecting the chamber 78 with the tube 74. The valve member 88 is connected to the diaphragm 92 via a rod 90. A chamber 94 is formed on a side of the diaphragm 72 opposite to the chamber 78. In the chamber 94, which is opened to the atmosphere through an air vent hole 98 formed in the body 76, a spring 96 is arranged which urges the diaphragm toward the valve seat 84. The above mentioned apparatus according to the invention operates as follows.

When the engine is rotated, the eccentrically mounted rotor 28 on the drive shaft 27 of the air pump 24 and the vane V mounted on the outer surface of the rotor 28 are rotated as shown by an arrow P. During this rotation, the contact relation of the outer end of the vane V with respect to the inner cylindrical surface $26_A$ of the housing 26, as well as the contact relation of the outer cylindrical surface of the rotor 28 with respect to said surface $26_A$ are always maintained. As a result of this, chambers $C_1$ and $C_2$, the volume of each of which is alternately expanded and contracted during each rotation, are formed in the air pump 24 between the housing 26, the rotor 28 and the vane V. Thus, an amount of air is sucked from the air cleaner 10 into the inlet port 30 of the pump 24 via the union 34 and air hose 32, and is discharged from the outlet port 36 as shown by an arrow Q. The discharged air is introduced into the exhaust passageway 19' near the exhaust valve 19, as shown by an arrow R, through the flow control chamber 40, the air injection pipe 62, the check valve 64, the air injection manifold 66 and the air injection nozzle 68. The thus introduced secondary air oxidizes the CO and HC components remaining in the gas exhausted from the combustion chamber 18 of the engine.

Figure 2:
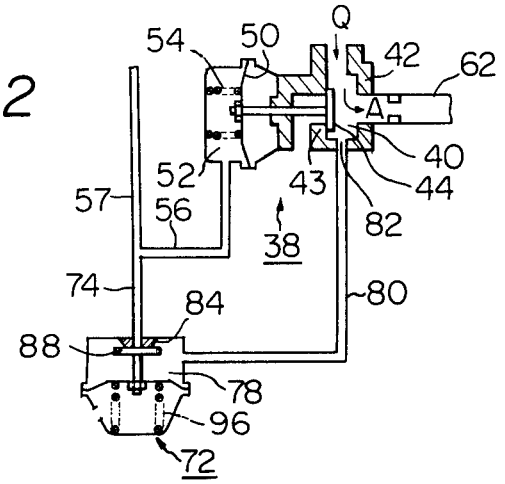
FIG. 2 shows a partial view of FIG. 1 showing a valving arrangement when the engine is operating under a low rotational speed.

In the above mennioned secondary air introduction operation, when the engine is in low rotational speed operation in which the rotational speed is not higher than a predetermined speed, for example 2,000 rpm, the amount of air discharged from the outlet 36 of the pump 24, as shown by the arrow Q, is small. This causes a secondary air of relatively low pressure to be passed through the flow control chamber 40 toward the air injection pipe 62, as shown by the arrow A. Therefore, the level of the pressure signal at the port 82, which is transmitted to the chamber 78 of the pressure control valve 72 through the tube 80, is not high enough to displace the diaphragm 92 against the spring 96. Therefore, the valve member 88, as shown in FIG. 2, rests on the valve seat 84 by the force of the spring 96 to close the communication between the tube 74 and the chamber 78. As a result of this, a full level of vacuum signal at the port 58 (FIG. 1) in the intake manifold 14 is permitted to be transmitted to the chamber 52 (FIG. 2) of the flow control valve 38 through the tubes 57 and 56. This causes the diaphragm 50 to be moved away from the body 42 against the spring 54, so that the valve member 44 is rested on the valve seat 43 to shut the communication between the chamber 40 and the atmosphere. As a result of this all the air discharged from the air pump 24 (FIG. 1), as shown by the arrow Q, can be introduced into the air injection pipe 62, as shown by the arrow A, toward the exhaust system. Generally speaking the pressure of the secondary air passed through the pipe 62 corresponds to the amount of the passed through air, which amount generally corresponds to the rotational speed of the pump 24, in other words, the rotational speed of the engine. Therefore, in this low rotational speed operation, in which the rotational speed does not exceed the predetermined rotational speed, for example 2,000 rpm, the pressure P of the secondary air in the pipe 62 is increased in accordance with the increase of the engine rotational speed, as shown by a line $m_1$ in FIG. 3. When the engine rotational speed reaches said predetermined speed, the pressure P becomes a predetermined constant pressure $P_1$.

When the engine is in a relatively high rotational speed operation, in which the rotational speed of the engine is higher than said predetermined speed (2,000 rpm), the amount of air discharged from the outlet of the pump 24, as shown by the arrow Q, become large. This causes a secondary air of relatively high pressure to be passed through the chamber 40 of the valve 38 toward the air injection pipe 62, as shown by the arrow A. Therefore, the level of the pressure signal at the port 82 (FIG. 1) which is transmitted to the chamber 78 of the pressure control valve 72 through the tube 80 become high enough to displace the diaphragm 92 against the force of the spring 96. Therefore, the valve member 88, as shown in FIG. 1, is detached from the valve seat 84 to open the chamber 78 to the chamber 52 of the flow control valve 38. As a result of this, the level of the vacuum signal transmitted into the chamber 52 through the tubes 56 and 57 from the port 58, is reduced to some extent by a positive pressure signal transmitted into the chamber 52 from the port 82, via to tube 80, the chamber 78 and the tubes 74 and 56. Thus, the diaphragm is displaced toward the body 42 by the force of the spring 54 as shown in FIG. 1 so that the valve member 44 is detached from the valve seat 43. As a result of this, a part of the air from air pump 24 is introduced into the air injection pipe 62 through the chamber 40, as shown by the arrow A, and the excess air is discharged into the atmosphere, as shown by the arrow B, from the port 43'.

Figure 3:
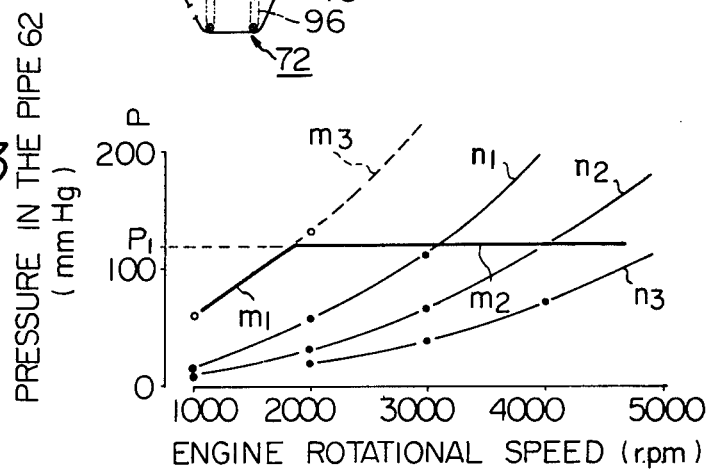
FIG. 3 shows graphs representing the relation between the engine rotational speed and the pressure of the secondary air in the pipe 62.

In this high rotational speed operation, in which the rotational speed is higher than the predetermined rotational speed of 2,000 rpm, the pressure P of the secondary air in the chamber 40, which is introduced into the air injection pipe 62, is maintained at the predetermined constant pressure $P_1$, as shown by a line $m_2$ in FIG. 3. When the pressure P is lower than the predetermined pressure $P_1$, due to relatively small amount of air passed through the chamber 40, as shown by the arrow A, a pressure signal of relatively low level is transmitted into the chamber 78 of the valve 72 from the port 82 via the tube 94. As a result of this, diaphragm 92 is displaced upwardly, so that the valve member 88 is seated on the valve seat 84. Thus, a full vacuum level at the port 58 can be transmitted to the chamber 52 of the valve 38, so that the diaphragm 50 is displaced away from the body 42, causing the valve member 82 to be moved away from the valve seat $42_B$. Therefore, the amount of air passed through the chamber 40, as shown by the arrow A, is increased in order to increase the pressure of the air to the predetermined pressure $P_1$. When the pressure P is higher than the predetermined pressure $P_1$, due to a relatively large amount of air passed through the chamber 40, a pressure signal of relatively high level is transmitted into the chamber 78 from the port 82 via the tube 94. As a result of this, the diaphragm 92 is moved downwardly, so that the valve member 88 is detached from the valve seat 84. Thus, the vacuum level at the chamber 52 is reduced, so that the diaphragm 50 is moved toward the body 42, causing the valve member 44 to be moved toward the valve seat $42_B$. Therefore, the amount of air passed through the chamber 40 toward the air injection pipe 62, as shown by the arrow A, is decreased, in order to decrease the pressure P of air to the predetermined pressure $P_1$.

Figure 4:
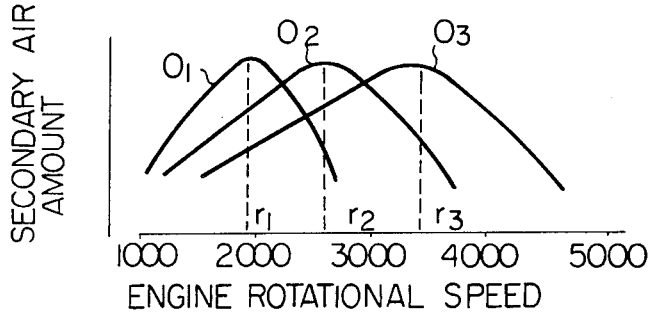
FIG. 4 shows graphs representing the relation between the engine rotational speed and the amount of secondary air directed to the engine exhaust manifold.

As is clear from the above-mentioned description, according to the invention, a constant secondary air pressure $P_1$ is obtained during high rotational speed engine operation, in which the engine rotational speed is larger than a predetermined rotational speed, for example 2,000 rpm. Therefore, the amount of the secondary air introduced into the engine exhaust system during said operation can be suppressed. This is because: (1) the amount of air introduced into the exhaust manifold 20 is determined by the pressure difference between the pressure of the secondary air in the air injection pipe 62 and the pressure of the exhaust gas in the exhaust pipe 20; (2) the pressure of the exhaust gas is increased in accordance with the engine rotational speed, as shown by curves $n_1$, $n_2$ and $n_3$ of FIG. 3 (in which $n_1$ corresponds to heavy load operation, $n_2$ corresponds to middle load operation and $n_3$ corresponds to light load operation); (3) the pressure of the secondaary air in the air injection pipe 62 is, as already described, maintained at said constant pressure $P_1$, as shown by a line $m_2$, when the engine rotational speed is larger than the predetermined speed and, therefore; (4) the amount of secondary air, which is proportional to the difference between the pressure of the secondary air and the pressure of the exhaust gas, decreases from rotational speeds $r_1$, $r_2$ and $r_3$ as shown by curves $o_1$, $o_2$ and $o_3$ in FIG. 4 (in which the curve $o_1$ corresponds to the heavy load operation, the curve $o_2$ corresponds to the middle load operation and the curve $o_3$ corresponds to light load operation). The rotational speed at which the amount of secondary air decreases ($r_1$, $r_2$ and $r_3$) is decreased in accordance with the increase of the load on the engine.

As is clear from the above description of the operation of the present invention, the amount of secondary air is effectively decreased during high rotational and heavy load engine operation, and therefore, the catalytic converter 22 is effectively prevented from being overheated during said operation.

While this invention has been described with reference to a particular embodiment, many modification can be made by those skilled in the art without departing from the scope and sprit of the invention.

What is claimed is:

1. An apparatus for introducing secondary air into an exhaust system of an internal combustion engine fitted with a catalytic converter comprising:

an air pump driven by the crankshaft of said engine for supplying secondary air;

first pipe means having a first end connected to said exhaust system at a position located upstream of said catalytic converter;

second pipe means having a first end connected to an intake system of said engine;

vacuum operated flow control valve means coupling a second end of said first pipe means to the output of said air pump; said flow control valve means having a control input coupled to a second end of said second pipe means and being responsive to an engine intake vacuum signal for controlling the amount of secondary air from the output of said air pump which is introduced into said pipe means and for discharging excess secondary air emitted from said air pump which is not introduced into said pipe means;

a third pipe means having one end connected to said vacuum operated flow control valve means for sensing the pressure of said introduced secondary air; and pressure control valve means having a control input connected to a second end of said third pipe means and being responsive to the pressure of said introduced secondary air to controllably decrease the effect of said intake vacuum signal applied to said vacuum operated flow control valve to maintain a predetermined constant non-zero pressure level of said introduced secondary air in said first pipe means.

2. An apparatus according to claim 1, wherein said vacuum operated flow control valve means comprises:

a body having a first chamber which forms an inlet connected to said pump, a first outlet connected to said first pipe means for introducing secondary air into said pipe means, and a second outlet opened to the atmosphere for discharging said excess amount of secondary air; a first valve member arranged between said first and second outlets for controllably supplying secondary air into said first pipe means through said first outlet and into said atmosphere through said second outlet; and, valve operation means having a spring biased first diaphragm for forming a second chamber on one side of said diaphragm, said second chamber being connected via said third pipe means to a first signal port formed in an intake system of the engine to introduce said engine intake vacuum signal to said second chamber, said first diaphragm being connected to said first valve member for moving it between said first and second outlets in accordance with the vacuum level in said second chamber in order to control the amount of secondary air introduced into the first pipe means through the first outlet of the first chamber.

3. An apparatus according to claim 2, wherein said pressure control valve means comprises:

a body; a spring biased diaphragm arranged in said body to form a third chamber which is connected via said third pipe means to a second signal port formed in the body of the flow control valve means, said second signal port being adapted for transmitting to said third chamber a pressure signal which indicates the pressure of secondary air introduced into said pipe means; a valve seat formed in the body of the pressure control valve means surrounding a control port, said control port communicating said third chamber with the second chamber of the flow control valve means; and, a valve member connected to the second diaphragm and facing the valve seat so as to open or close said control port in accordance with the pressure level in said third chamber, so that the vacuum level in the second chamber is decreased or increased to control the amount of secondary air introduced into said first pipe means in such a manner that said predetermined non-zero constant pressure level of introduced secondary air is maintained.

4. An apparatus as in claim 2, wherein said pressure control valve is inoperative to reduce the effect of said intake vacuum signal until said introduced secondary air pressure reaches a predetermined value.

* * * * *